US007316093B2

(12) United States Patent
Kightlinger

(10) Patent No.: US 7,316,093 B2
(45) Date of Patent: Jan. 8, 2008

(54) FIREARM AND MUNITIONS KIT

(76) Inventor: Paul E. Kightlinger, 11045 E. Escalante Rd., Tucson, AZ (US) 85730

( * ) Notice: Subject to any disclaimer, the term of this patent is extended or adjusted under 35 U.S.C. 154(b) by 238 days.

(21) Appl. No.: 11/312,515

(22) Filed: Dec. 21, 2005

(65) Prior Publication Data

US 2006/0248773 A1 Nov. 9, 2006

Related U.S. Application Data

(63) Continuation-in-part of application No. 10/645,532, filed on Aug. 22, 2003, now abandoned.

(60) Provisional application No. 60/419,537, filed on Oct. 21, 2002.

(51) Int. Cl.
*F41A 21/10* (2006.01)
*F42B 5/02* (2006.01)

(52) U.S. Cl. ..... 42/77; 102/430

(58) Field of Classification Search ..... 42/77, 42/76.01, 76.1; 89/14.05, 29; 102/430, 102/439, 464

See application file for complete search history.

(56) References Cited

U.S. PATENT DOCUMENTS 1,353,118 A 9/1920 Thompson
2,455,080 A 11/1948 Miller et al.
3,209,691 A 10/1965 Herter
3,442,172 A * 5/1969 Lorenz et al. ..... 89/16
3,566,792 A 3/1971 Grandy
3,805,434 A * 4/1974 Sudano ..... 42/77
4,459,774 A * 7/1984 Ferretti ..... 42/77
4,682,545 A 7/1987 Jett
4,803,926 A 2/1989 Barton et al.
5,033,386 A 7/1991 Vatsvog
5,275,108 A 1/1994 Chernicky et al.
5,463,959 A 11/1995 Kramer (Continued)

FOREIGN PATENT DOCUMENTS

GB 2381060 A * 4/2003

OTHER PUBLICATIONS

"The RCBS Load Cartridge Designer Utility"; published on Internet Apr. 31, 2001; http://www.qmdr.com/rcbs/rcbstext9.html, p. 14.

(Continued)

*Primary Examiner*—James S Bergin
(74) *Attorney, Agent, or Firm*—Richard C. Litman

(57) ABSTRACT

The firearm and munitions kit is a cartridge and a barrel insert for a firearm adapted to fire munitions comprising a 223 round. The cartridge has an axis, a neck, a shoulder, a body, an extraction groove, and a slight frustoconical shape extending axially from the widest body diameter to the beginning of the shoulder. The barrel insert is appropriately chambered and provided for operability with the cartridge and round. A chamber of the barrel insert has an axis, a neck bore, a shoulder bore, and a body bore. The shoulder and the shoulder bore are formed at an angle of approximately 29°, ±0.5° with respect to the axis of the chamber. Upon firing a firearm equipped with the barrel insert and munitions of the present invention, the round is capable of reaching a minimum velocity of greater than 2,000 fps.

14 Claims, 5 Drawing Sheets

U.S. PATENT DOCUMENTS

| | | | |
|---|---|---|---|
| 5,490,463 | A | 2/1996 | Lamberty et al. |
| 5,565,646 | A | 10/1996 | Williams |
| 5,610,365 | A | 3/1997 | Thiesen |
| 5,703,322 | A | 12/1997 | Tidman |
| 5,826,361 | A | 10/1998 | Jamison |
| 5,970,879 | A | 10/1999 | Jamison |
| 6,253,682 | B1 | 7/2001 | Saxby |
| 6,293,203 | B1 | 9/2001 | Alexander et al. |
| 6,354,221 | B1 | 3/2002 | Jamison |
| 6,532,876 | B1 | 3/2003 | Ramirez et al. |
| 6,595,138 | B2 | 7/2003 | Jamison |
| 6,675,717 | B2 | 1/2004 | Jamison |
| 2005/0028421 | A1 * | 2/2005 | Saxby et al. ..... 42/77 |

OTHER PUBLICATIONS

"The Reload Bench"; published on the Internet Aug. 4, 20011 http://www.reloadbench.com/cartridges/22250.html, pp. 1 and 2.

* cited by examiner

FIREARM AND MUNITIONS KIT

CROSS-REFERENCE TO RELATED APPLICATION

This application is a continuation-in-part of prior U.S. patent application Ser. No. 10/645,532 filed Aug. 22, 2003 now abandoned, which claims the benefit of U.S. Provisional Application No. 60/419,537, filed Oct. 21, 2002.

BACKGROUND OF THE INVENTION

1. Field of the Invention

The present invention relates to a firearm and munitions kit having a custom cartridge, custom chamber, and custom barrel adapted for use in combination with a variety of handguns in which the kit adapted handgun is modified to fire a bullet with an outside diameter of about 0.223 inches (") while maintaining compatibility with a stock cartridge magazine of the adapted handgun.

2. Description of the Related Art

Prior art firearms which fire bullets with an outside diameter of about 0.223" often require the use of a relatively large firearm with a relatively large cartridge and chamber. Specifically, the diameter of the cartridge and chamber is often greater than 0.400" and/or the length of the cartridge is often greater than 1.000". Also, the neck and shoulder of prior art cartridges and chambers are typically provided at such an angle that the cartridge does not feed properly from the magazine into the barrel. These problems result in a slow round. In other words, it takes a comparatively long time for the round to advance from the magazine to the barrel upon pulling the trigger. Further, the dimensions of the cartridge and chamber result in wear and tear on the firearm. For instance, upon firing, some prior art cartridges are found to peen or damage the metal on the locking lugs. In addition, the prior art chambers and cartridge are typically capable of only achieving sub 2,000 fps bullet velocity.

A variety of cartridges and chambers for 0.223" bullets have been proposed, all of which have one or more of the problems identified above. U.S. Pat. No. 5,033,386, issued Jul. 23, 1991 to Vatsvog, describes a composite cartridge for a .223 caliber high velocity rifle. The outside diameter of the Vatsvog cartridge at its widest point is 0.398". The length and shoulder angle of the Vatsvog cartridge are not discussed.

U.S. Pat. No. 5,970,879 issued Oct. 26, 1999 and U.S. Pat. No. 6,354,221 B1 issued Mar. 12, 2002, both to Jamison, describe high-power firearm cartridges. Both Jamison patents are directed to a cartridge in a first embodiment with an overall length L of about 2.2", a shoulder angle of approximately 35°, and a diameter D of between about 0.53 and 0.54", and a cartridge in a second embodiment with an overall length L of about 1.7", a shoulder angle of at least 30° but less than 40°, and most preferably approximately 35°, and a diameter D of at least about 0.45", and preferably 0.533". Independent claims 1 and 3 of the '879 patent are specifically limited to a cartridge with a diameter of at least 0.53" and 0.45", respectively. Independent claim 2 of the '879 patent discloses a cartridge longer than 1.25", since the claim requires a first portion having an outside diameter at a location 1.25" from the first end. The independent claims of the '221 patent disclose similar limitations. Cartridges with a shorter length, a smaller shoulder angle, or a smaller diameter are not taught or suggested by the Jamison patents.

U.S. Pat. No. 6,293,203 B1, issued Sep. 25, 2001, to Alexander et al., describes a cartridge for a 5.56 millimeter (mm) (0.224") projectile. Although the independent claims of the Alexander patent recite a limit velocity not less than 518 meters per second (m/s), or 1,700 feet per second (fps), FIG. 5 of the Alexander patent shows a maximum limit velocity of about 2,000 fps. The angle y of the Alexander patent is not claimed, but is disclosed to be 32° in the preferred embodiment. The preferred embodiment of Alexander has a cartridge with an outside diameter A of 10.80 mm (0.425"). There is no teaching or suggestion in Alexander for a limit velocity of greater than 2,000 fps, an angle of less than 32°, or an outside diameter of less than 10.80 mm (0.425").

None of the above inventions and patents, taken either singly or in combination, is seen to describe the instant invention as claimed. Thus, a firearm and munitions kit solving the aforementioned problems is desired.

SUMMARY OF THE INVENTION

The firearm and munitions kit is a cartridge and a cylindrical barrel insert for a firearm adapted to fire a bullet with an outside diameter of about 0.223" (also known as a 223 round). The cartridge has an axis, a neck, a shoulder, a body, an extraction groove, and a slight frustoconical shape extending axially from the widest body diameter to the beginning of the shoulder.

The barrel insert of the present invention is appropriately chambered and provides a body bore, shoulder bore and neck bore for operability with the cartridge and round described above. The shoulder and the shoulder bore are formed at an angle of approximately 29°, ±0.5° with respect to the axis of the chamber. The cartridge has a conforming shape to fit snugly inside the body bore, shoulder bore and neck bore of the cylindrical barrel insert. Upon firing a firearm equipped with the cartridge and barrel insert of the present invention, the bullet has a minimum velocity of 2,000 fps and is capable of reaching a maximum velocity of greater than approximately 2,500 fps.

The firearm and munitions kit may be designed to adapt a variety of handguns and rifles so that they may fire a 223 round with higher kinetic energies rivaling the kinetic energies produced by larger munitions fired from firearms having longer barrel lengths. Additionally, the chambering and cartridge of the kit provides compatibility with existing clips and magazines of the modified firearms.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
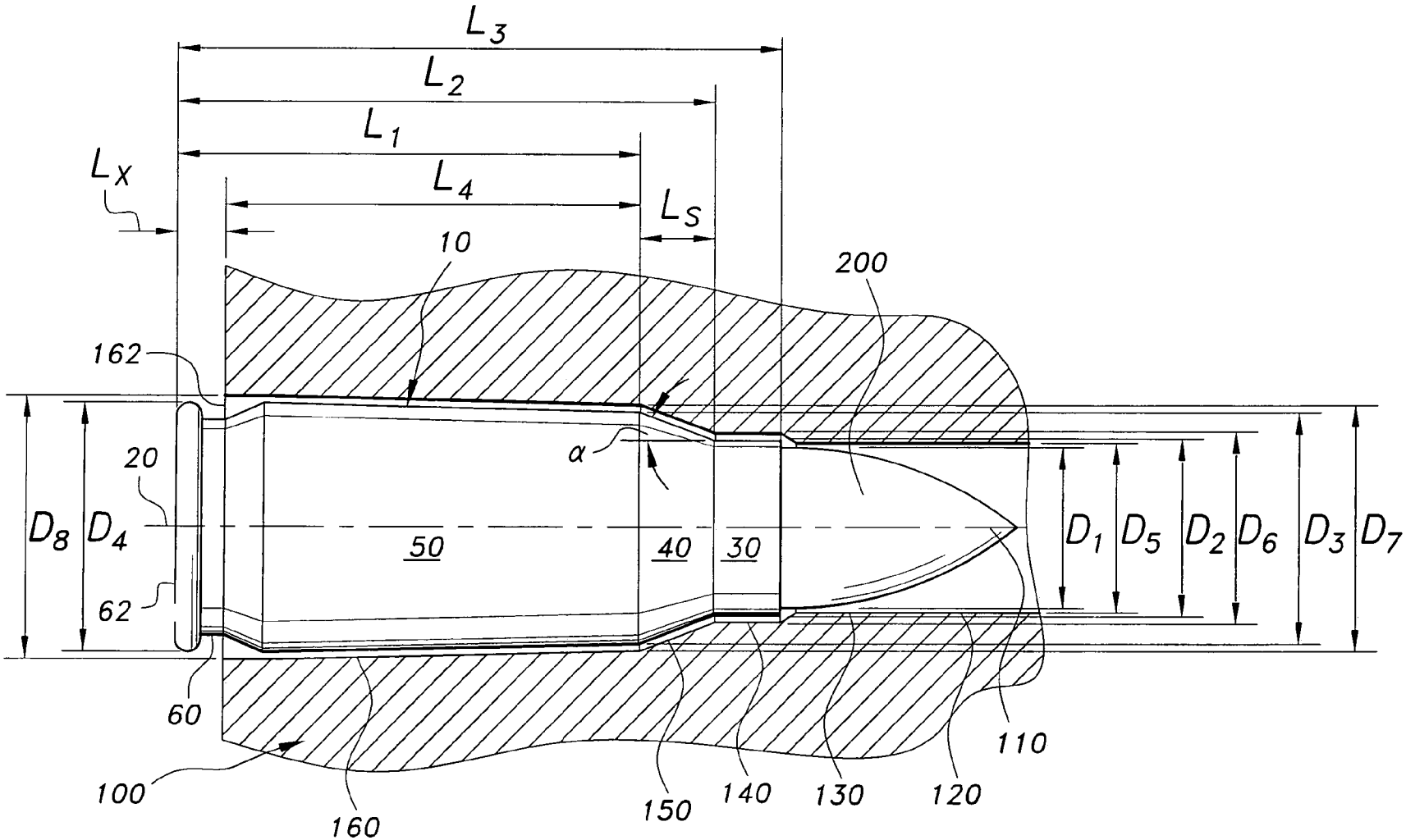
FIG. 1 is a side view of cartridge and bullet, along with side cutaway view of chamber of barrel insert, according to the present invention.
Figure 2:
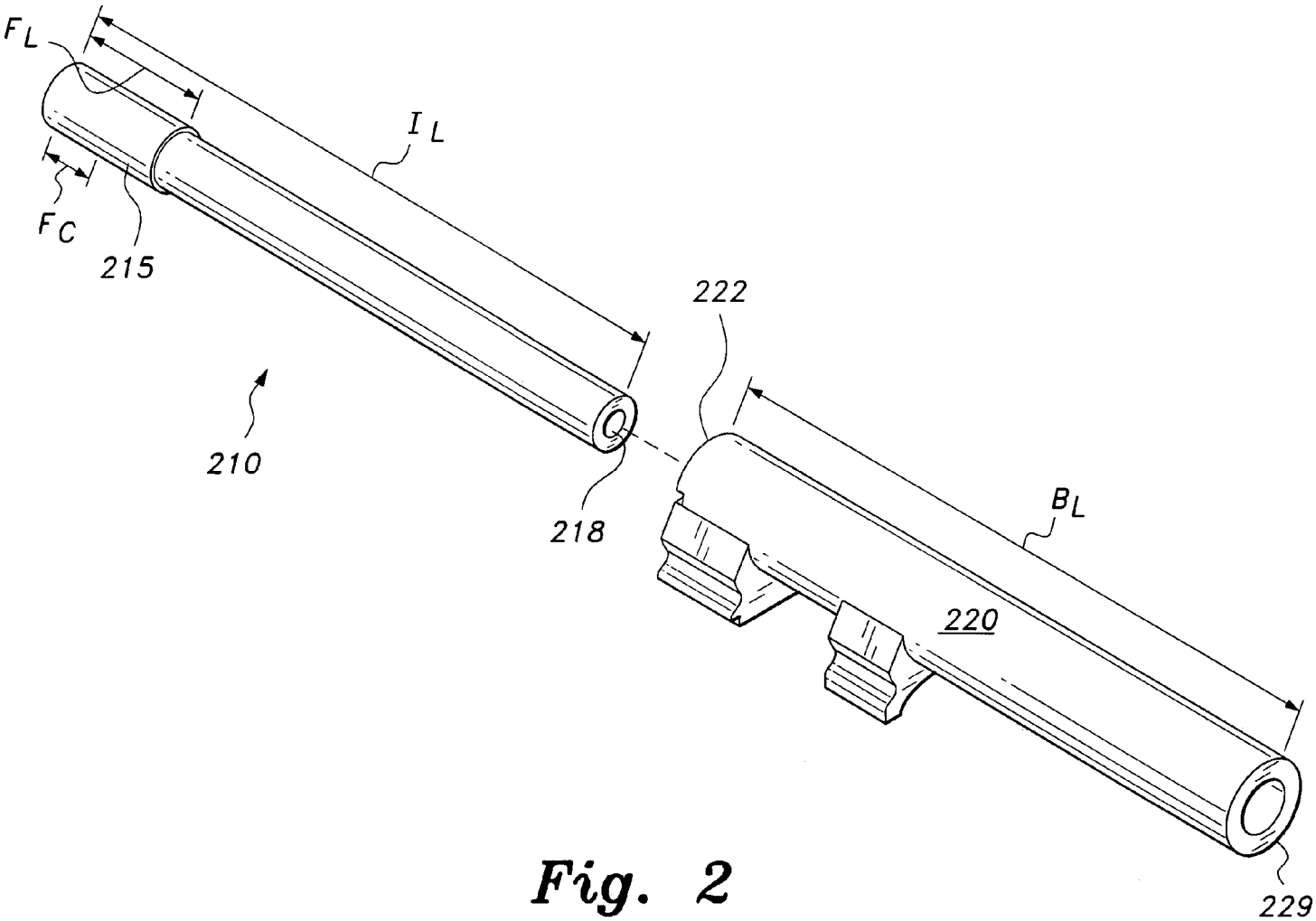
FIG. 2 is an exploded, perspective view of the insert and original gun barrel, according to the present invention.
Figure 7:
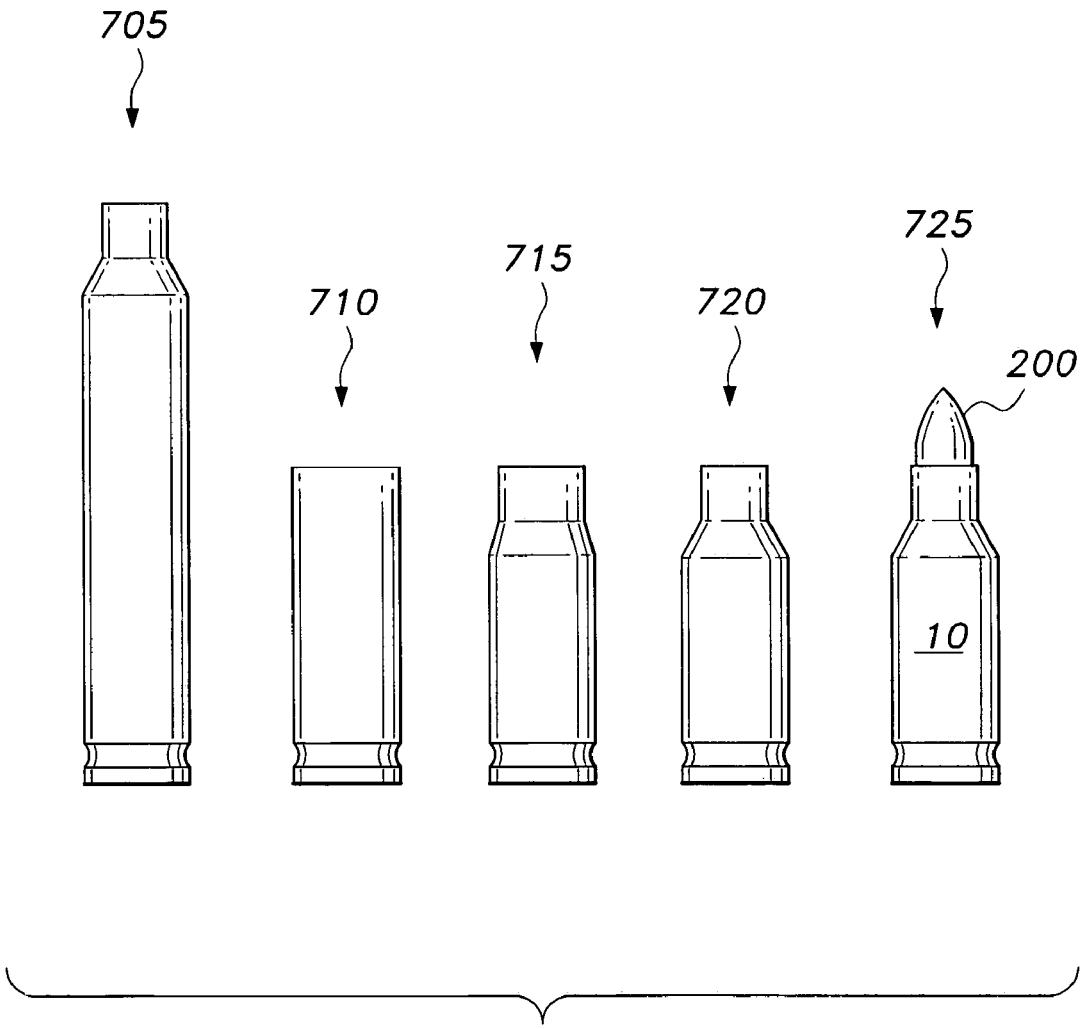
FIG. 7 is an elevational view of munitions, according to the invention.

As shown in the FIGS. 1, 2 and 7, the present invention is directed to a firearm and munitions kit comprising munitions 725 including a cartridge 10 with bullet 200, and a cylindrical barrel insert 210 having a cylindrical collar 215, an axial through bore 218, and a chamber 100. The firearm and munitions kit may be designed to adapt a firearm such as a handgun or a rifle, to fire smaller caliber, higher kinetic energy munitions without increasing the firearm's barrel length or modifying the firearm's magazine, as described in detail below. Specifically, the cartridge 10, chamber 100 and through bore 218 are provided to adapt a firearm having a relatively short barrel length so that the firearm can fire the bullet 200 having an outside diameter $D_1$ of about 0.223", (also known as a 223 round), at kinetic energies previously unheard of in short barreled firearms.

The cartridge 10 comprises an axis 20, a neck 30, a shoulder 40, a body 50, and an extraction groove 60. The cartridge 10 has a total length $L_3$ that may be between 0.870 and 1.000". The cartridge 10 is typically made of brass, but may also be made of iron, or other suitable types of metal.

Figure 4:
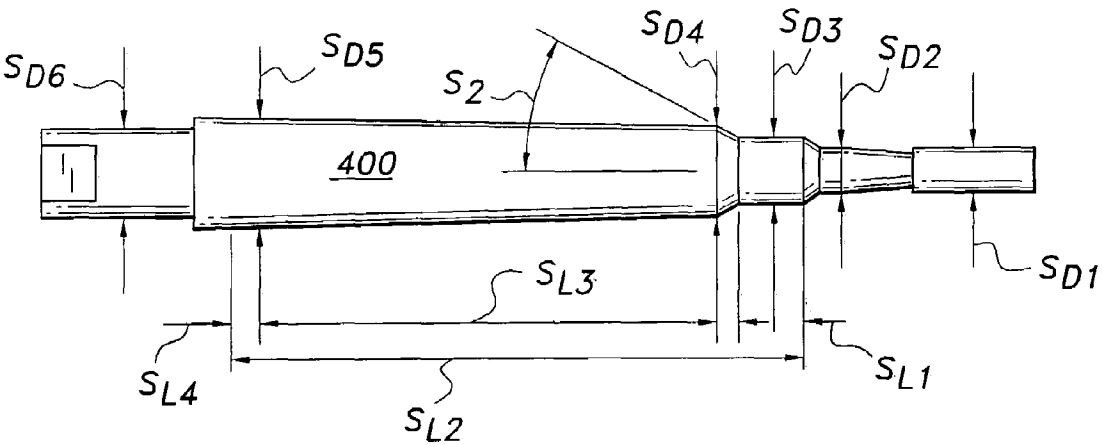
FIG. 4 is a side view of the brass cartridge die sizer, according to the present invention.
Figure 6:
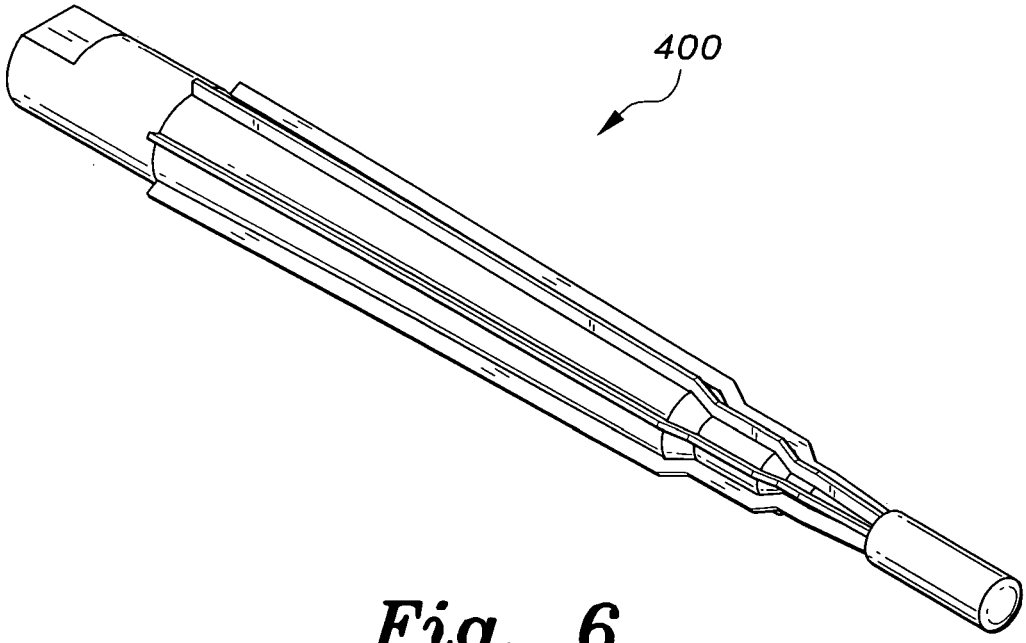
FIG. 6 is a perspective view of the brass cartridge die sizer, according to the present invention.

According to the present invention, brass cartridges may advantageously be custom designed from standard military brass cartridges such as the familiar Winchester® rifle 556 cartridge by cutting down and resizing the original cartridge with a cartridge resizing tool 400 (see FIGS. 4, 6 and 7).

The body 50 is hollow and generally cylindrical with a closed end opposite the bullet 200. The body 50 comprises a body first outside diameter $D_4$, a body second outside diameter $D_3$, a body length $L_1$, and the extraction groove 60. The body first outside diameter $D_4$, which is the diameter of the body 50 at its widest point, is about 0.372", ±0.005". The body second outside diameter $D_3$ is less than the first body outside diameter $D_4$ to create a slight frustoconical shape extending axially from the widest body diameter, i.e., body first outside diameter $D_4$ to the beginning of a shoulder at the body second outside diameter $D_3$. A ratio of the body first outside diameter to the body second outside diameter is preferably in the range of 1.008:1 to 1.02:1 to provide the slight frustoconical shape of the body 50. Thus, the body second outside diameter $D_3$ may be about 0.368", ±0.005". The ratio of the first body outside diameter $D_4$ to the outside diameter $D_1$ of the bullet 200 is between 1.66 to 1 and 1.70 to 1. In a preferred embodiment of the invention, the ratio is 1.66 to 1.

As shown in FIGS. 4, 6 and 7, the cartridge 10 is formed by application of the customized resizing tool 400 to a bolt-like cartridge die (not shown) to provide a corresponding size and shape which is adapted to form the cartridge 10 as described herein.

Referring to FIG. 1, it is shown that the body length $L_1$ is measured from the terminal end 62 of the body 50 on the end opposite the bullet 200 (left side of FIG. 1) to the intersection of the body 50 with the shoulder 40. The body length $L_1$ is between 0.670 and 0.800".

When placed in the chamber 100 of the present invention, a properly sized cartridge 10 overhangs, i.e., protrudes from the chamber a small axial distance $L_x$ which varies from approximately 0.090 inches when adapted to modify a Beretta 92® handgun, to approximately 0.145 inches when adapted to modify a Colt 1911® handgun. The axial overhang $L_x$ is provided so that the firearm extractor may properly engage the extraction grooves 60.

In a first preferred embodiment of the invention, identified by the inventor as the PK224 cartridge, the body length $L_1$ is about 0.675", ±0.005", the axial length $L_2$ of the body 50 and the shoulder 40 is about 0.775",±0.005", and total length $L_3$ is about 0.875". The ratio of the body length $L_1$ to a cartridge shoulder length $L_s$ is approximately 6.75:1.

In a second preferred embodiment of the invention, identified by the inventor as the PK2224 cartridge, the body length $L_1$ is about 0.735", ±0.005", the axial length $L_2$ of the body 50 and the shoulder 40 is about 0.835", ±0.005", and total length $L_3$ is about 0.935", ±0.005". The ratio of the body length $L_1$ to the cartridge shoulder length $L_s$ is approximately 7.35:1.

In a third preferred embodiment of the invention, identified by the inventor as the PK224S or PK224 Super cartridge, the body length $L_1$ is about 0.795", ±0.005", the axial length $L_2$ of the body 50 and the shoulder 40 is about 0.895", ±0.005", and total length $L_3$ is about 0.995", ±0.005". The ratio of the body length $L_1$ to the cartridge shoulder length $L_s$ for the super cartridge is approximately 7.95:1.

The neck 30 is hollow and generally cylindrical provided on the terminal end 62 of the cartridge 10 adjacent to the bullet 200 (right side of the Figure). The neck 30 has a neck outside diameter $D_2$ of approximately 0.260", but greater than 0.254". The neck 30 is adapted to fit the bullet 200.

The shoulder 40 is hollow and conical provided between the body 50 and the neck 30. The shoulder 40 may be formed at an angle $\alpha$ between the body 50 and the neck 30 where the angle $\alpha$ is about 29°, ±0.5°, preferably 28.8°, with respect to the axis 20 of the cartridge 10. The angle $\alpha$ of the shoulder 40 is shallower than many prior art cartridges. The shallower angle of the present invention is desirable in that it promotes proper feeding of the cartridge 10 from the magazine of the firearm.

Referring to FIGS. 1, 4 and 7, the cartridge resizing tool 400 has dimensions approximately $1/1000^{th}$ inch less than the aforementioned dimensions of cartridge 10. The cartridge resizing tool 400 has a pilot diameter $S_{D1}$ of approximately 0.2180 inches provided to start, or pilot the reaming process as the reamer is spinning up on a lathe or similar rotary instrument. The cartridge resizing tool 400 is applied to ream the inside of the threaded bolt-like resizing die (not shown). $S_{D2}$, having an approximate 0.224 inch diameter corresponds to fit the cartridge to the diameter of the bullet 200. $S_{D3}$ having a diameter of 0.254 inches is provided to form the diameter of the neck 30. The frustoconical shape having a 28.8° angle, $S_2$ defined by the difference between $S_{D4}$ and $S_{D3}$ articulates the formation of the shoulder 40. The slight frustoconical shape defined by the difference between $S_{D5}$ and $S_{D4}$ articulates the formation of the body 50. Cartridge die sizer 400 is designed to have dimensions having diameters approximately $1/1000^{th}$ inch greater than the cartridge diameters, i.e., the cartridge die has a contour $1/1000^{th}$ of an inch greater than the cartridge diameters.

According to the present invention, a moderately fast burning gunpowder is uniformly distributed, i.e., loaded into the hollow inside space of cartridge 10. Since the firearm and munitions kit comprising the insert 210 and munitions 725 has been designed to adapt short barreled firearms, i.e., firearms having a barrel length of 6 inches or less, such as barrel 220 having a barrel length $B_L$, slow burning gunpowder has been theoretically shown to be incompatible with the present invention. It is therefore within the scope of the present invention to provide cartridges 10 having gunpowder, preferably a spherical pistol powder, with density characteristics and a relatively fast burn rate similar to the Hodgdon H110™ gun powder. Such a powder has a density of 15.244 grains/cc.

Characteristic load data according to the present invention are illustrated in Tables 1 through 3 below:

TABLE 1

PK2224 Beretta 92 OAL 1.165 9 mm Magazine

| Bullet wt grains | Primer military/commercial | Powder (H110) wt grains | Velocity fps |
|---|---|---|---|
| 30 | Yes/Yes | 12.2-12.4 | 2460 |
| 33 | Yes/Yes | 11.6-12.0 | 2398 |
| 35 | Yes/Yes | 11.6-11.9 | 2425 |
| 38 | Yes/Yes | 11.5-11.7 | 2356 |
| 45 | Yes/Yes | 10.4-11.0 | 2032 |

TABLE 2

PK224S Sized to fit 9 mm Magazine OAL 1.165

| Bullet wt grains | Primer military/commercial | Powder (H110) wt grains | Velocity fps |
|---|---|---|---|
| 30 | Yes/No | 13.1 | 2639 |

TABLE 3

PK224S COLT 1911 OAL 1.265 38 Super Magazine

| Bullet wt grains | Primer military/commercial | Powder (H110) wt grains | Velocity fps |
|---|---|---|---|
| 30 | Yes/Yes | 13.1-13.3 | 2639 |
| 33 | Yes/Yes | 12.5-12.8 | |
| 35 | Yes/Yes | 12.2-12.8 | |
| 38 | Yes/Yes | 11.9-12.1 | |
| 45 | Yes/Yes | 11.6-11.8 | |
| 46 | Yes/Yes | 11.6-11.8 | |

It should be noted that gunpowders having a similar density yet a much slower burn rate, such as Hodgdon H414™, a spherical rifle powder, should not be used with the present invention, as dangerous barrel pressures could develop using these slower burning gunpowders.

The barrel modification component of the firearm and munitions kit of the present invention comprises a cylindrical barrel insert 210 including an axial through bore 218 adapted to forming a chamber 100 having a total length $L_3$ between 0.870 and 1.000" and a short length barrel bore 120 having a total length of $I_L$-$F_L$ through which a bullet 200 with an outside diameter of about 0.223" may be fired.

The barrel insert 210 is press fitted inside a gun barrel of the firearm that is to be modified by the kit of the present invention so that a distal end of the barrel insert 210 is concentrically proximate to a muzzle 229 of the original gun barrel, and a proximal end of the insert, i.e., the chambered end, is concentrically proximate to a breech end 222 of the original barrel. Axial stability of the barrel insert 210 is achieved by means of an axial stop against the breech end of the original gun barrel provided by a cylindrical collar 215 at the proximal end of the insert 210.

The chamber 100 of the insert 210 adapted to fit cartridge 10 and the bullet 200. The barrel bore 120 has an inside diameter $D_5$ of about 0.224". The barrel bore 120 may be provided with a region 130 adapted to fit the ogive of the bullet 200. The chamber 100 comprises an axis 110, a neck bore 140, a shoulder bore 150, and a body bore 160.

Figure 3:
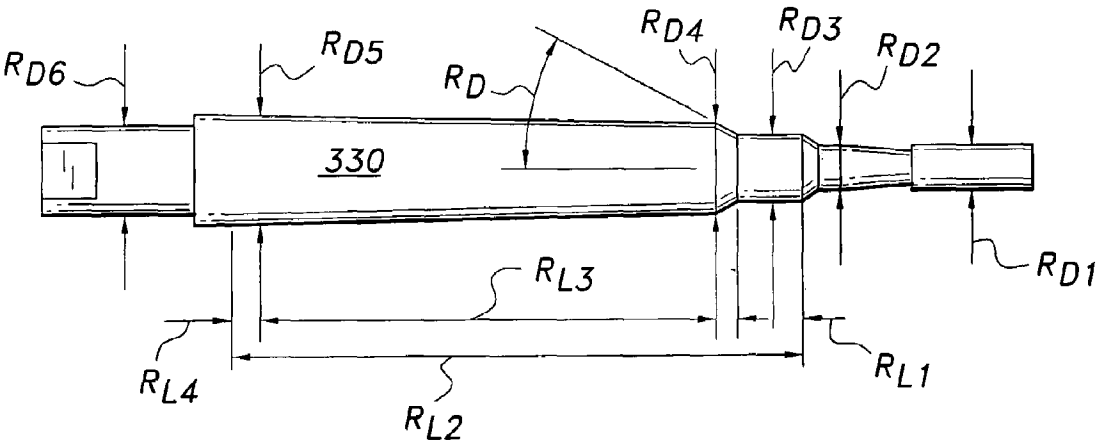
FIG. 3 is a side view of the barrel reamer, according to the present invention.
Figure 5:
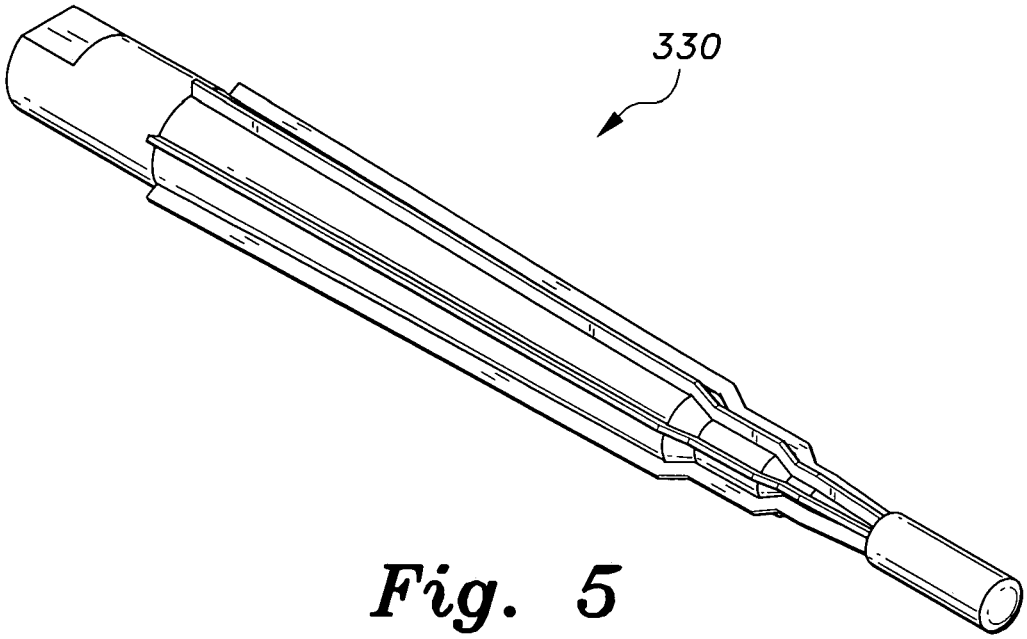
FIG. 5 is a perspective view of the barrel reamer, according to the present invention.

As shown in FIGS. 3 and 5, the chamber 100 is formed by application of a customized chamber reamer 330 to the cylindrical barrel insert 210. The chamber reamer 330 is provided in a size and shape corresponding to specifications required to form the chamber 100 as described herein. The chamber reamer may be provided with up to five or six flutes. The flutes of the chamber reamer may be straight.

The body bore 160 is generally cylindrical with open ends. The body bore 160 comprises a body bore first inside diameter $D_8$, a body bore second inside diameter $D_7$, and a body bore length $L_4$ adapted to receive the cartridge 10. The body bore first inside diameter $D_8$, which is the diameter of the body bore 160 at its widest point, is about 0.376", ±0.005". The body bore second inside diameter $D_7$ is less than the first body bore inside diameter $D_8$. A ratio of the body bore first inside diameter to the body bore second inside diameter is preferably in the range of 1.008:1 to 1.02:1 to provide the slight frustoconical shape of the body bore 160.

The body bore second inside diameter $D_7$ preferably is 0.373", but greater than 0.372 inches. The ratio of the first body bore inside diameter $D_8$ to the outside diameter $D_1$ of the bullet 200 is between 1.65 to 1 and 1.70 to 1. In a preferred embodiment of the invention, the ratio is 1.66 to 1.

The body bore length $L_4$ is measured from the terminal end 162 of the body bore 160 on the end opposite the bullet 200 (left side of FIG. 1) to the intersection of the body bore 160 with the shoulder bore 150. The body bore length $L_4$ is sufficient in length to receive the cartridge 10, which as noted above, has a cartridge body length $L_1$ between 0.670 and 0.800".

In a first preferred embodiment of the invention, the chamber 100 is adapted to receive the PK224 cartridge, and the body bore length $L_4$ is adapted to receive the cartridge 10 where the cartridge body length $L_1$ is about 0.675", ±0.005", the axial length $L_2$ of the body 50 and the shoulder 40 is about 0.775", ±0.005", and total length $L_3$ is about 0.875".

In a second preferred embodiment of the invention, the chamber 100 is adapted to receive the PK2224 cartridge, and the body bore length $L_4$ is adapted to receive the cartridge 10 where the cartridge body length $L_1$ is about 0.735", ±0.005", the axial length $L_2$ of the body 50 and the shoulder 40 is about 0.835", ±0.005", and total length $L_3$ is about 0.935", ±0.005".

In a third preferred embodiment of the invention, the chamber 100 is adapted to receive the PK224S cartridge, and the body bore length $L_4$ is adapted to receive the cartridge 10 where the cartridge body length $L_1$ is about 0.795", ±0.005", the axial length $L_2$ of the body 50 and the shoulder 40 is about 0.895", ±0.005", and total length $L_3$ is about 0.995", ±0.005".

The neck bore 140 is generally cylindrical provided on the end of the chamber 100 adjacent to the bullet 200 (right side of FIG. 1). The neck bore 140 has a neck bore inside diameter $D_6$ of approximately 0.263 inches, but greater than 0.2625 inches.

The shoulder bore 150 is conical and provided between the body bore 160 and the neck bore 140. The shoulder bore 150 may be formed at an angle $\alpha$ between the body bore 160 and the neck bore 140 where the angle $\alpha$ is about 29°, ±0.5°, preferably 28.8°, with respect to the axis 110 of the chamber 100. The angle $\alpha$ of the shoulder bore 150 is shallower than many prior art chambers. The shallower angle of the present invention is desirable in that it promotes proper feeding of the cartridge 10 from the magazine into the chamber 100 of the firearm.

Again, referring to FIGS. 3 and 5, the customized chamber reamer 330 has dimensions approximately $1/1000^{th}$ inch less than the aforementioned dimensions of chamber 100. The chamber reamer 330 has a pilot diameter $R_{D1}$ of approximately 0.2180 inches provided to start, or pilot the reaming process as the reamer is spinning up on a lathe or similar rotary instrument.

$R_{D2}$, having a 0.225 inch diameter corresponds to the diameter of barrel bore 120. $R_{D3}$ having a diameter of 0.2625 inches corresponds to the diameter of the neck bore 140. The frustoconical shape having a 28.8° angle, $R_D$ defined by the difference between $R_{D4}$ and $R_{D3}$ articulates the formation of the shoulder bore 150. The slight frustoconical shape defined by the difference between $R_{D5}$ and $R_{D4}$ articulates the formation of the body bore 160.

The insert 210 and munitions 725 are adapted for cooperative use with each other. The kit comprising insert 210 and munitions 725 may be adapted to retrofit a variety of handguns and rifles. For example, kit comprising insert 210 and munitions 725 has successfully modified short barreled firearms such as the Colt 2000®, Ruger P85®, Ruger P95®, military Beretta 92®, Glock 17®, and an originally 45 caliber handgun.

The kit has successfully modified a Colt civilian model AR15 rifle that was converted to a pump type rifle. The AR15 is similar to a military M16 rifle. A standard AR15 is chambered for the Remington 223. When adapting the chambering of a rifle such as the AR15, by using the customized chamber reamer 330, the munitions 725 of the present invention increases the kinetic energy such that the modified AR15 is capable of firing a bullet at about 3,000 fps.

A standard 9 mm handgun is capable of firing a bullet at about 1,000 fps. When using a firearm equipped with the kit comprising insert 210 and munitions 725 of the present invention, the bullet 200 has a minimum velocity of 2,000 fps and is capable of reaching a velocity of greater than about 2,500 fps.

A standard double stack magazine for a 9 mm handgun accepts the cartridge 10 of the present invention without modification to the magazine. The cartridge 10 and chamber 100 of the firearm and munitions kit result in a significantly faster round than that of a comparable unmodified firearm.

In other words, it takes a comparatively short time for a subsequent round of the present invention to advance from the magazine to the barrel upon firing the chambered round. In using the cartridge 10 and chamber 100 of the present invention with a 9 mm handgun, there is less recoil, less muzzle jump, better control, the user is back on target quicker, and the handgun is generally much faster as compared to a conventional 9 mm handgun.

The cartridge 10 and chamber 100 of the present invention may also be adapted for use with any rifle that accepts a 223 round. Accuracy is also improved by using the firearm and munitions kit of the present invention. For example, at 300 feet, the inventor was able to place 7 rounds into a ⅜" shot pattern. A summary of firearm tests performed by the inventor is outlined below in Table 4.

Firearm Results Summary

TABLE 4

| Range (yds) | Firearm(s)/Round | Target Penetration? |
|---|---|---|
| 15 | Kit PK2224 35 gr | Yes 1.25" cement |
| 18 to less than 25 yd | Kit for Ruger/Beretta PK2224 | Yes .190" steel plate (all of multiple shots penetrated the plate) |
| 18 to less than 25 yd | Unmodified P90 machine gun/FN57AP | Yes .190" steel plate (some of multiple shots penetrated the plate) |
| 25 yd | Kit for Ruger P85/PK2224 | Yes .190" steel plate(most of multiple shots penetrated the plate) |
| 25 yd | Unmodified FN57 Pistol | NO .190" steel plate |
| 18 to <25 yd | Unmodified 9 mm/115 gr, 44 SPL/(200 gr JNP CCI), 40 SW/(180 gr FMJ), 44 mag/(240 gr JNP WIN), 357 SIG/(125 gr FMJ WIN), 357 SIG/(125 gr JNP FED), 38 SPL/(125 gr STHP), 45 ACP/(230 gr FMJ WIN), 357 MAC/(125 gr SJHP REM) | NO .190" steel plate |

The PK 2224 munitions 725 and barrel insert 210 of the present invention having a barrel length less than 6 inches consistently demonstrated sufficient kinetic energy to penetrate a $3/16^{th}$ inch steel plate at a range between 18 and 25 yards. Additionally, it is within the scope of the present invention to provide a complete firearm and munitions without barrel insert 210, but having the aforementioned barrel, chamber, cartridge and loading specifications of the firearm and munitions kit discussed herein.

It is to be understood that the present invention is not limited to the embodiments described above, but encompasses any and all embodiments within the scope of the following claims.

I claim:

1. A firearm and munitions kit, comprising:

a cylindrical insert adaptable to being press fitted inside an original barrel of a firearm so that a distal end of the insert is concentrically proximate to a muzzle of the original barrel and a proximal end of the insert is concentrically proximate to a breech end of the original barrel; the cylindrical insert also having a cylindrical collar at the proximal end to provide an axial stop against the breech end of the original barrel; the cylindrical insert further including an axial through bore provided to accept a .223 caliber bullet for firing; the through bore at the most proximal end of the cylindrical insert having a body bore first inside diameter extending axially towards the muzzle, to a body bore second inside diameter; a ratio of the body bore first inside diameter to the body bore second inside diameter being within the range of (1.008:1) to (1.013:1); the through bore having an approximate 29 degree shoulder angle as it further extends axially towards the muzzle for a predetermined axial shoulder length; the ratio of the body bore length to the predetermined axial shoulder length being within a range of approximately (5.95:1) to (7.95:1); a further axial extension of the through bore having a constant diameter and forming a neck bore having a predetermined neck bore axial length; a ratio of the predetermined axial shoulder length to the predetermined neck bore axial length being approximately (1:1); the remainder of the axial through bore extending to the muzzle comprising a barrel bore having an inside diameter of approximately 0.224 inches, wherein the total barrel length is no greater than the original barrel length; a munitions comprising a cartridge having a hollow inside space; the munitions further comprising the .223 caliber bullet; the cartridge having a conforming shape to fit snugly inside the body bore, shoulder bore and neck bore of the cylindrical insert; the cartridge conforming shape comprising a body having a body first outside diameter, a body second outside diameter, a body length, and an extraction groove; a ratio of the body first outside diameter to the body second outside diameter being within the range of (1.008:1) to (1.02:1); the cartridge further comprising a shoulder having a shoulder angle of approximately 29° with respect to an axial centerline of the cartridge; the shoulder angle being provided so that the shoulder tapers while extending axially forward of the body to form a predetermined cartridge shoulder length; a ratio of the body length to the predetermined cartridge shoulder length being within a range of approximately (6.75:1) to (7.95:1); the cartridge further including a neck disposed axially forward of the shoulder, the neck having a neck outside diameter and a neck length; the neck outside diameter being substantially less than the body second outside diameter; a ratio of the predetermined cartridge shoulder length to the predetermined neck length being approximately (1:1); a moderately fast burning spherical gunpowder being uniformly disposed in the hollow inside space of the cartridge; an opening of the neck being closed off by and fitted to the bullet; the munitions capable of being operatively stored in an unmodified magazine of the firearm; wherein upon firing the munitions from the firearm which has been adapted by the firearm and munitions kit, the bullet is capable of reaching a minimum velocity of greater than 2,000 fps.

2. The firearm and munitions kit according to claim 1 further comprising: the firearm and munitions kit being capable of adapting a variety of stock handguns of various calibers.

3. The firearm and munitions kit according to claim 2, wherein the capability of adapting a variety of stock handguns of various calibers includes the capability of adapting a variety of stock 9 mm handguns.

4. The firearm and munitions kit according to claim 1 further comprising: the firearm and munitions kit being capable of adapting a variety of bolt action rifles having a 22 caliber bore.

5. The firearm and munitions kit according to claim 1, wherein the body bore first inside diameter is approximately 0.376 inches, but greater than 0.375 inches.

6. The firearm and munitions kit according to claim 1, wherein the body bore second inside diameter is approximately 0.373 inches, but greater than 0.372 inches.

7. The firearm and munitions kit according to claim 1, wherein the neck bore inside diameter $D_6$ is approximately 0.263 inches, but greater than 0.2625 inches.

8. The firearm and munitions kit according to claim 1, wherein the body first outside diameter of the cartridge is approximately 0.372 inches, but greater than 0.371 inches.

9. The firearm and munitions kit according to claim 1, wherein the body second outside diameter is approximately 0.368 inches, but greater than 0.367 inches.

10. The firearm and munitions kit according to claim 1, wherein the neck has a neck outside diameter of approximately 0.260 inches but greater than 0.254 inches.

11. The firearm and munitions kit according to claim 1, wherein the ratio of the cartridge body length to the cartridge shoulder length is approximately (7.35:1).

12. The firearm and munitions kit according to claim 11, wherein the barrel length of the firearm is less than 6 inches.

13. The firearm and munitions kit according to claim 12, wherein a fired munitions from a handgun adapted by the kit consistently has sufficient kinetic energy to penetrate a $3/16^{th}$ inch steel plate at a range between 18 and 25 yards.

14. The cartridge according to claim 1, wherein, upon firing, the bullet is capable of reaching a velocity of greater than about 3,000 fps.

* * * * *